United States Patent [19]

Watanabe et al.

[11] Patent Number: 4,871,271

[45] Date of Patent: Oct. 3, 1989

[54] PRINTING HEAD FOR A WIRE DOT PRINTER

[75] Inventors: Kazuo Watanabe; Yutaka Takahashi; Masaaki Takimoto, all of Tokyo, Japan

[73] Assignee: Fuji Photo Film Co., Ltd., Japan

[21] Appl. No.: 86,444

[22] Filed: Aug. 18, 1987

[30] Foreign Application Priority Data

| | | | |
|---|---|---|---|
| Aug. 20, 1986 | [JP] | Japan | 61-194839 |
| Aug. 20, 1986 | [JP] | Japan | 61-194840 |
| Aug. 20, 1986 | [JP] | Japan | 61-194841 |
| Aug. 20, 1986 | [JP] | Japan | 61-194842 |
| Aug. 20, 1986 | [JP] | Japan | 61-194843 |
| Aug. 20, 1986 | [JP] | Japan | 61-194844 |

[51] Int. Cl.[4] ..... B41J 3/12

[52] U.S. Cl. ..... 400/124; 101/93.05; 400/157.2; 400/167; 310/323

[58] Field of Search ..... 400/167, 121, 124, 157.2; 101/93.04, 93.05, 93.02; 310/323, 326, 327

[56] References Cited

U.S. PATENT DOCUMENTS

| | | | |
|---|---|---|---|
| 4,174,182 | 11/1979 | Lendl | 400/124 |
| 4,176,976 | 12/1979 | Lendl | 400/124 |
| 4,600,322 | 7/1986 | Vermot-Gaud | 400/124 |
| 4,732,498 | 3/1988 | Vermot-Gaud | 400/124 |

FOREIGN PATENT DOCUMENTS

| | | | |
|---|---|---|---|
| 81181 | 5/1984 | Japan | 400/124 |
| 1322876 | 7/1973 | United Kingdom | 400/124 |

OTHER PUBLICATIONS

*IBM Tech. Disc. Bulletin,* by R. Lane, vol. 27, No. 2, Jul. 1984, pp. 1105–1108.

*Primary Examiner*—Paul T. Sewell

*Attorney, Agent, or Firm*—Pasquale A. Razzano

[57] ABSTRACT

A printing head for use with an electrodynamic type wire dot printer includes an electrodynamic wire actuator disposed in a magnetic field to be deformed by an electromagnetic force, a printing pin fixedly supported by the electrodynamic wire actuator, and an anti-rebound damping member in cooperation with either the electrodynamic wire actuator or the printing pin. The wire actuator is resiliently deformed so as to give the printing pin a movement between a position wherein the printing pin rests and a position whereat the printing pin hits a platen roller through an ink ribbon and a printing paper wrapped around the platen roller, thereby to print an ink dot on the printing paper. When the printing pin is returned to the rest position, a electric voltage is applied to and, as a result, deforms the anti-rebound damping member to retain either the electrodynamic wire actuator or the printing pin in order to rapidly stop the printing pin at the rest position.

19 Claims, 12 Drawing Sheets

PRINTING HEAD FOR A WIRE DOT PRINTER

BACKGROUND OF THE INVENTION

The present invention relates to a printing head for a wire dot printer, and more particularly to a low noise, high speed electrodynamic printing head for a wire dot printer.

As print-out devices for use with computers, wire dot printers of the type having a clapper type printing head are widely known. This clapper type printing head has a wire actuator with an armature attached to one end thereof. When the armature is attracted by an electric magnet, the wire actuator is given an impact at its top end so as to hit an ink ribbon from its back to print an ink dot on a printing paper.

Because the clapper type wire dot printer is very noisy due to the impact given by the armature, a low noise wire dot printer has been desired. A wire dot printer that is hopeful as a low noise type is of an electrodynamic type wire dot printer disclosed in, for example, Japanese patent unexamined publication No. 60—206,669. The electrodynamic type wire dot printer taught by the above Japanese patent unexamined publication comprises an actuator having a printing pin disposed in a magnetic field. This actuator comprises two curved wires which are connected to each other at one ends where the printing pin is fixed and, on the other hand, fixedly supported at the other ends with keeping a distance therebetween, so as to be formed in a generally Y-shaped configuration. By passing an electric current pulse through the actuator from one wire to the other wire to generate an electromagnetic force, the actuator is resiliently deformed to give the printing pin a thrust movement. Since, in the electrodynamic type printing head, the printing pin can hit the platen roller around which a printing paper is wrapped without being accompanied with impact, the printing head does not produce large noise and can be simple in structure.

There is known an improved electrodynamic type wire dot printing head, namely a transversal type wire dot printing head. The transversal type wire dot printing head has a straight, transversely disposed wire actuator with a printing pin held approximately at the middle. The straight wire actuator is supported by resiliently deformable wires rounded semicircular and attached to both ends thereof. By passing an electric current pulse through the straight wire actuator disposed in a vertical magnetic field, the straight wire actuator is shifted in the direction of the axis of the printing pin against the resiliency of the semicircular supporting wires to hit a platen roller through an ink ribbon so as to print an ink dot on a printing paper wrapped around the platen roller. After the ink dot printing, by applying a counter current pulse to the straight wire actuator, the printing pin is caused to return to its initial or rest position.

For effecting a high speed ink dot printing, the printing head is required to have an actuator operative at a high operating frequency. However, the conventional electrodynamic wire dot printing head is limited to at most 300 Hz in operating frequency and, therefore, unsuitable for high speed printing. The cause of the low operating frequency of the printing head is that, when the printing pin returns to its initial or rest position, the printing pin does not rest quickly and will rebound to oscillate diminishingly with respect to its rest position. If a current pulse is passed through the actuator wire during the diminishing oscillation, the magnetic force produced by the magnet is partially cancelled. As a result, it is hard to cause the printing pin to travel a sufficient stroke and to give an impact required to effect a desirable print of ink dot on the printing paper. For this reason, the conventional printing head is prevented from repeating to effect a successive printing until the printing pin completely rests in its rest position. Therefore, the period required to print one ink dot is prolonged, resulting in a slow speed dot printing.

There actually occurs a rebound of the printing pin, an ink dot will be overprinted double or triple and, thereby, a character or symbol formed by a lot of ink dots becomes non-uniform in depth. Moreover, if the printing paper is advanced during the double or triple overprinting, a distorted character will be printed.

OBJECT OF THE INVENTION

It is therefore an object of the present invention is to provide a low noise printing head for a wire dot printer.

It is another object of the present invention to provide a high speed printing head for a wire dot printer.

SUMMARY OF THE INVENTION

For accomplishing the above and other objects, according to the present invention, the wire dot printing head comprises an electrodynamic wire actuator fixedly supporting a printing pin which is disposed in a magnetic field and resiliently deformed by an electromagnetic force so as to give the printing pin a movement between a position wherein the printing pin rests and a position where the printing pin hits a platen roller through an ink ribbon and a printing paper wrapped around the platen roller, thereby to print an ink dot on the printing paper; and anti-rebound damping means for retaining the printing pin in the rest position.

According to a preferred embodiment of the present invention, the anti-rebound damping means which is cooperative either directly with the printing pin or with the electrodynamic actuator is electrically actuated to retain the printing pin or the electrodynamic actuator in its rest position at the end of returning stroke of the printing pin. According one of the preferred embodiments, the anti-rebound damping means is comprised by an piezoelectric member which is resiliently deformable by an application of voltage thereto. When applying a voltage, the piezoelectric member deforms to mechanically retain a part of either the printing pin or the electrodynamic actuator, thereby completely restricts it to move further.

Alternatively, the anti-rebound damping means is comprised by at least a pair of elastically deformable members; one of them being provided on the printing pin and the other being fixed to a stationary fixed portion of the printing head. When applying a electric current pulse to the pair of members, a repulsion force is generated between the members to attract the one provided on the printing pin to the fixed one, thereby retains the printing pin in the rest position. If the electrodynamic actuator takes the form of a cantilever, it is desirable to use a bimorph vibration element as the anti-rebound damping means which is adapted to deform resiliently, so as to prevent an oscillatory rebounding of the cantilever.

According to a feature of the present invention, as the electrodynamic actuator is used to cause a reciprocating movement of the printing pin between the rest position and the hitting position so as to hit periodically a printing paper wrapped around a platen roller through an ink ribbon in order to print ink dots on the printing paper, low noise printing is realized. In addition to the low noise printing, as the anti-rebound damping means is used in cooperation with the electrodynamic actuator, the printing pin is prevented from bounding or oscillating after having printed an ink dot. Therefore, high speed printing is realized.

BRIEF DESCRIPTION OF THE DRAWINGS

FIG. 2 is a schematic illustration of the printing head of an embodiment according to the present invention;

DETAILED DESCRIPTION OF THE INVENTION

Figure 1:
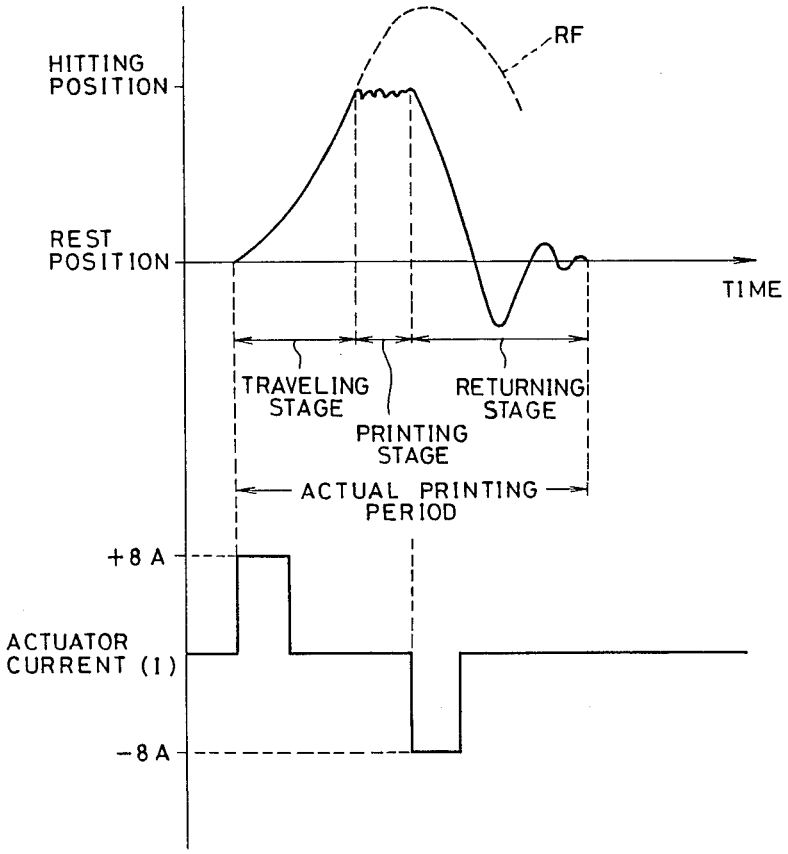
FIG. 1 (PRIOR ART)
FIG. 1 is a diagram showing the operation of a conventional printing head for a wire dot printer wherein a piezoelectric damping means is in cooperated with the printing pin.

The electrodynamic wire dot printing head according to preferred embodiments of the present invention incorporates various elements, similar to those of conventional wire dot printing heads. Because such elements are well known to those skilled in the art, this description will be directed to elements forming parts of, or cooperating directly with, the printing head embodying the present invention.

Before the description of the present invention proceeds, it is to be noted that like parts or elements are designated by like reference numerals and symbols throughout the views of the accompanying drawings.

For a better understanding of the present invention, a supplementary explanation will be given with reference to FIG. 1 as to causes that the conventional electrodynamic printing head is not improper to effect a high speed dot printing.

When passing a current of, for example, +8 A through the actuating wire holding a printing pin of the conventional electrodynamic type wire dot printing head for 0.5 msec at the beginning of dot printing, the actuating wire will deform resiliently, moving the printing pin to hit a platen roller around which a printing paper is wrapped through an ink ribbon to print an ink dot on the printing paper. Traveling stage is defined by the period for which the printing pin moves from its initial or rest position to a hitting position where the printing pin hits the platen roller through the ink ribbon and the printing paper. In the traveling stage, the printing pin moves forward according to a resonance frequency curve shown by a chained line RF in FIG. 1.

When the printing pin hits the platen roller, an ink dot is transferred to and, thereby, printed on the printing paper. The period between hitting and printing is referred to as a hitting stage. As is understood in FIG. 1, the printing pin slightly oscillates in the hitting stage.

When a counter current of, for example, −8 A is applied to the actuating wire, the actuating wire deforms due to its own resiliency and an electromagnetic force exerted, thereon returns the printing pin to its rest position. The return of the printing pin to the rest position is referred to as a returning stage. In the returning stage, the actuator, and hence the printing pin, does not stop quickly and will continue to oscillate with respect to the rest position. If in the returning stage, a current of +8 A is applied to the actuating wire, the electromagnetic force applied to the printing pin decreases. As a result, an insufficient force may be imparted upon the printing pin to effect a desirable dot printing.

Referring now to FIG. 2, there is shown an electrodynamic wire dot printing head embodying the present invention. In this embodiment, anti-rebound damping means is provided in cooperation directly with a printing pin. A looped-wire actuator 9 comprises a pair of resiliently deformable actuating wires 10 and 11 which are connected at their one ends to each other. The other ends of the actuating wires 10 and 11 are kept apart from each other and fixedly supported by a part of a main body 15 of the printing head. At the connected ends, the actuator 9 holds firmly a printing pin 12 made of electrically conductive material. Therefore, the actuator 9 comprising the actuating wires 10 and 11 and the printing pin 12 are formed as to be an electrically integral whole. While, if the printing pin 12 is made of electrically non-conductive material such as ceramics, the two wires 10 and 11 may be formed integral with each other. Above and under the actuator 9, there are magnets 13 so arranged as to produce a magnetic field perpendicular to the surface plan of the drawing.

The printing pin 12 cooperates with anti-rebound damping means comprising a resiliently deformable annular guide bush 16 and an annular deformable ring of piezoelectric element 17 which is supported by a guide plate 18 of the printing head and in which the annular guide bush 16 is fitted. The printing pin 12 is supported by the guide bush 16 for axial movement. The guide plate 18 is disposed adjacent to an ink ribbon 19 which is close a platen roller (not shown) around which a printing paper 20 is wrapped.

For the actuating wire 10, 11, a phosphor bronze wire or a beryllium-copper alloy wire of diameter about 0.25 mm is used. For the printing pin 12, it is desirable to use a stainless steel wire of diameter about 0.25 mm. The guide bush 16 is preferred to be made of materials having a flexibility, an insulation effect and a durability, for example polyamido, teflon, polyestel or the like. The guide bush 16 is finished with an inside diameter 0.3 mm and an outside diameter 0.5 mm. For the piezoelectric deformable annular element 17, an annular ring of plumbate-zirconate-titanate ceramic is finished with an inside diameter 0.5 mm and an inside diameter 1.0 mm.

Figure 3:
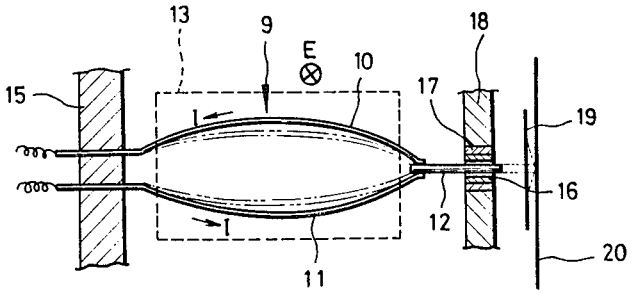
FIG. 3 is a diagram showing the operation of the printing head of FIG. 2.
Figure 4:
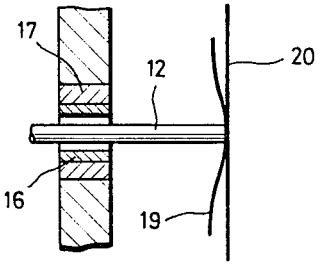
FIG. 4 is a cross sectional view showing the printing pin of the printing head of FIG. 2 which is in the hitting position.

The operation of the above printing head will be described with reference to FIG. 3. When passing a current I through the actuating wires 10 and 11 in a direction shown by arrows in FIG. 2 while applying a magnetic field to the magnets 13, an electromagnetic force is produced and acts on the actuating wires 10 and 11. As a result, the actuating wires 10 and 11 are resiliently deformed as is shown by a double dotted line in FIG. 2 to effect the traveling stage of the printing pin 12. In the traveling stage, the printing pin 12 is guided by the guide bush 16 and moves forward to the platen roller. At the end of the traveling stage, the printing pin 12 hits the printing paper 20 through the ink ribbon 19 as is shown in FIG. 4. In the hitting stage, the printing pin 12 transfers ink of the ink ribbon 19 to the printing paper 20 so as to make an ink dot of the size corresponding to the diameter of the printing pin 12 on the printing paper 12.

Figure 5:
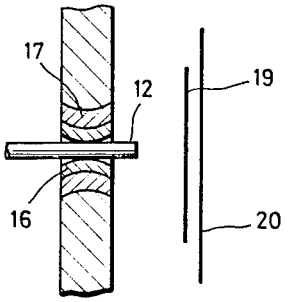
FIG. 5 is a cross sectional view similar to FIG. 4 but the printing pin is in the rest position.
Figure 3:
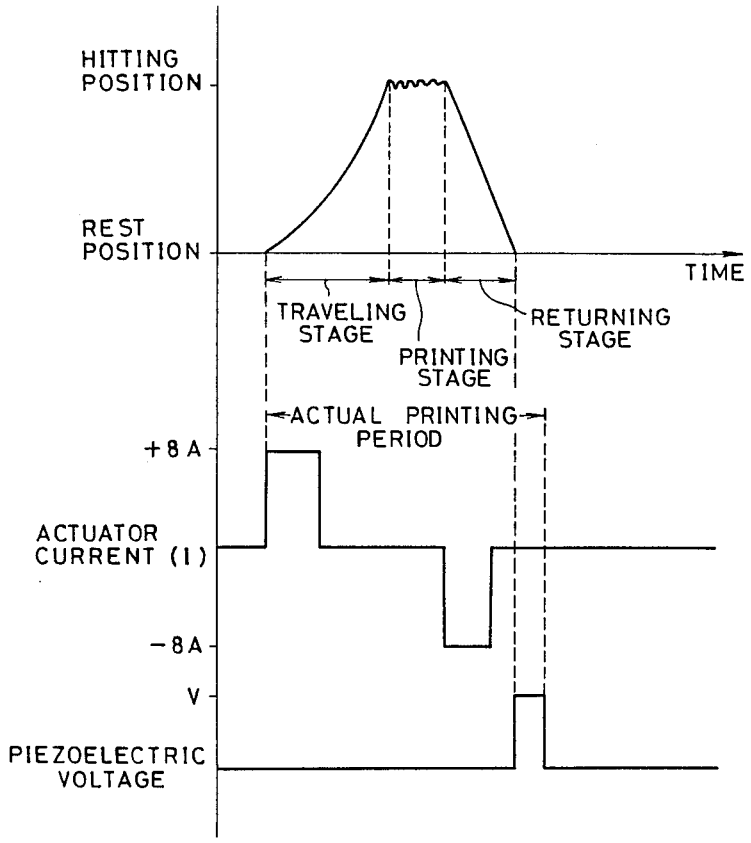

At the end of the printing stage, a counter current I is passed through the actuator wires 10 and 11 from the wire 10 to the wire 11 in order to effect the returning stage. In this returning stage, the printing pin 12 rapidly returns under the electromagnetic force and the resiliency of its own. At the time the printing pin 12 fully returns its rest position, the piezoelectric annular element 17 is applied with a pulsed voltage, thereby being deformed as is shown in FIG. 5. Due to the deformation of the piezoelectric annular element 17, the guide bush 16 is forced to deform to nip the printing pin 12. Consequently, the printing pin 12 stops quickly, namely without producing any oscillation such as shown by a chained line in FIG. 1. Because of this quick stop of the printing pin 12, the period of the returning stage is shortened and, the following traveling stage can be started at any desired time. Therefore, the printing head can be driven with a high repetition rate so as to effect a high speed dot printing.

It is noted that, in this embodiment, although a pulse voltage is applied to the piezoelectric annular element, 17, a voltage may be continuously applied to it until the beginning of the following traveling stage. If there is a time lag between the voltage application of the piezoelectric element 17 and the stopping of the printing pin 12, it is advantageous to apply a voltage a little faster to the piezoelectric element 17.

Figure 6:
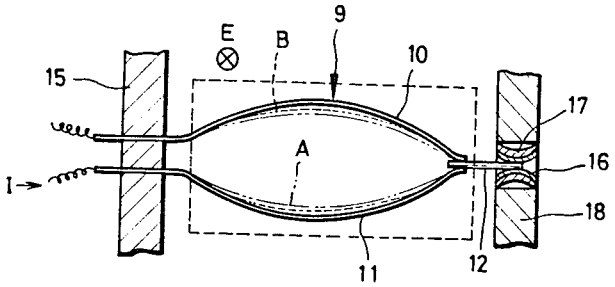
FIG. 6 is a schematic illustration, similar to FIG. 2, of the printing head of another embodiment according to the present invention.

FIG. 6 shows a modification of the embodiment of the present invention shown in FIGS. 2 through 5, wherein the printing pin 12 is retained in a rest position different from the previous embodiment. In this modified embodiment, the actuator wires 10 and 11 are adapted to deform between a hitting position shown by a dotted line A where the printing pin 12 hits the platen roller to print an ink dot on the printing paper and an overextended position shown by a solid line beyond a rest position shown by a chained line B where the printing pin 12 rests. When the actuating wires 10 and 11 reach the overextended position, the actuating wires 10 and 11 are caused to return to the rest position by its own resiliency. However, in this modified embodiment, the piezoelectric annular element 17 is applied with a voltage to deform when the actuating wires 10 and 11 reach the overextended position, deforming the guide bush 16 so as to clamp the printing pin 12. When removing the voltage applied to the piezoelectric annular element 17 upon starting the traveling stage, the actuating wires 10 and 11 deform quickly by their own resiliency and an electric magnetic force to move the printing pin 12 toward the hitting position. Due to the deformation of the actuating wires 10 and 11, the traveling stage of the printing pin 12 is performed in a shortened period of time.

Figure 7:
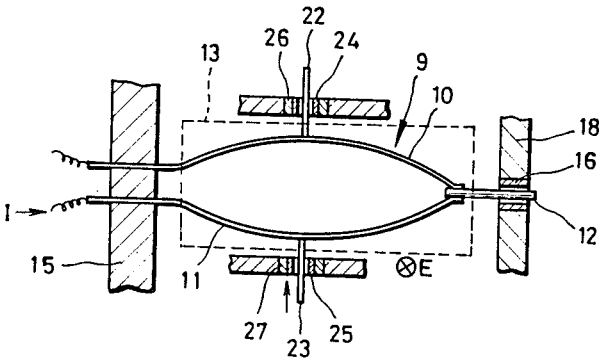
FIG. 7 is a schematic illustration, similar to FIG. 2, of the printing head of another embodiment according to the present invention wherein piezoelectric damping means is incooperation with a looped-wire electrodynamic actuator.

FIG. 7 shows another modification-on of the embodiment of the present invention shown in FIGS. 2 through 5, wherein a pair of the anti-rebound damping means are provided in cooperation with the respective actuating wires 10 and 11 through damping pins 22 and 23 laterally extending from the actuating wires 10 and 11. Each damping pin 22, 23 is slidably supported by a guide bush 24, 25 fitted in a piezoelectric deformable annular element 26, 27 fixed to a part of the main body of the printing head. According to the printing head thus constructed, in the returning stage, the actuating wires 10 and 11 are firmly retained in the overextended position through the engagement between the damping pins 22 and 23, and the deformable piezoelectric element 26 and 27.

Figure 8:
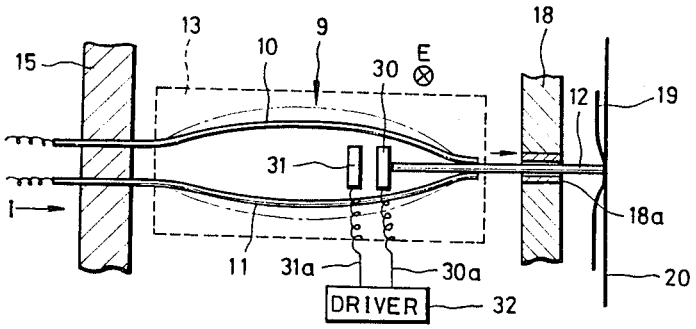
FIG. 8 is a schematic illustration, similar to FIG. 2, of the printing head of still another embodiment according to the present invention wherein electrode plate member type damping means is in cooperation with the printing pin.
Figure 9:
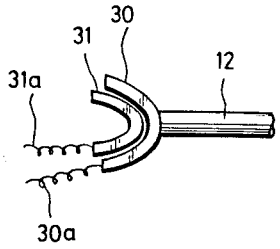
FIG. 9 is a side view showing partially the printing head of FIG. 8.

FIGS. 8 and 9 show another preferred embodiment of the electrodynamic wire dot printing head according to the present invention wherein the anti-rebound damping means is provided in connection directly with the printing pin 12. The anti-rebound damping means comprises a pair of electrode plate members 30 and 31 one of which is fixed to the the rear end of the printing pin 12 and the other to a part of the main body of the printing head. In this embodiment, the printing pin 12 is fixedly held at the middle by the actuating wires 10 and 11 and extends passing through a guide hole 18*a* formed in the guide plate 18 for axial movement. Disposed correspondingly to the electrode plate member 30 is the stationary electrode plate member 31. As is shown in FIG. 9, the electrode plate members 30 and 31 which have generally parabolic configuration in cross section and are formed complimentarily to each other in cross section are adapted to be placed close to each other when the printing pin is in its rest position. A driver 32 is electrically connected to the respective electrode plate members 30 and 31 by means of wires 30*a* and 31*a* so as to provide an electrostatic force therebetween. The driver 32 applies plate voltages contrary in polarity to each other to the electrode plate members 30 and 31 upon damping the printing pin 12.

The operation of the electrodynamic wire dot printing head 9 shown in FIGS. 8 and 9 is explained in connection with FIG. 10. For starting wire dot printing, under the application of electric field to the magnets 13, a current pulse I is passed through the actuating wires 10 and 11 in a direction shown by an arrow in FIG. 8 at a time t1. Electromagnetic force acts in such a direction as to make the actuating wires 10 and 11 move close to each other. At the same time, plate voltages having a same polarity are applied to the electrode plate members 30 and 31 by the driver 32 so as to produce a repulsive force between the electrode plate members 30 and 31.

As a result of the application of an electromagnetic force to the actuating wires 10 and 11 and the repulsive force to the electrode plate members 30 and 31, the printing pin 12 is brought forward from the rest position as is shown by an arrow in FIG. 8 and hits the platen roller through the ink ribbon 19 and the printing paper 20 wrapped around the platen roller. In consequence, an ink dot of the size corresponding to the diameter of the printing pin 12 is printed on the printing paper 20.

After the ink dot printing, the actuating wires 10 and 11 resiliently deforms to return to the rest position shown by a dotted line in FIG. 8. Due to the deformation of the actuating wires 10 and 11, the printing pin 12 is retracted toward the rest position. At a time t2 the printing pin 12 substantially reaches the rest position, the driver 32 applies plate voltages contrary in polarity to each other to the electrode plate members 30 and 31 to exert an attractive force between the electrode plate members 30 and 31. Consequently, the printing pin 12 rests on its rest position without any rebound. The application of the plate voltages contrary in polarity is continued from the time t2 to a time t3. Therefore, an actual time required to print one single ink dot is defined by the period between the times t1 and t3. The next ink dot printing period commences at a time t4 by applying a current pulse I to the actuating wires 10 and 11 and a same polarity of plate voltage to each electrode plate member 30, 31.

It is noted that, in order to make the printing pin 12 reciprocally moves as smooth as possible, the electrode plate members 30 and 31 are desirable to be made of light materials such as aluminium thin sheets, aluminium alloy foils, insulation plastic films coated with thin metal layers such as aluminium films or the like. Specifically, in this embodiment, the electrode plate member 30 includes a polyethylene terephtalate film of about 100 m thickness with a thin aluminium film and an acrylic resin thin film of about 2 m thickness coated in this order on a surface opposite to the electrode plate member 31. On the other hand, the electrode plate member 31 is made of an aluminium of 100 m thickness. The parabolic surfaces of each electrode plate member 30, 31 facing to the other has a surface area of about 1 $cm^2$. For the actuating wires 10 and 11, in this embodiment, the printing pin 12 has a length of about 65 mm.

If the magnets 13 are applied with about 6,000 gauss of magnetic field and an actuating current of 8 A is passed through the actuating wires 10 and 11, approximately two newtons of force is exerted on the printing pin 12. On the other hand, if a plate voltage of 100 V is applied to the electrode plate members 30 and 31 through air and the insulating resin film as media, an electrostatic force of about three newtons is generated. Accordingly, a sufficient damping force is exerted on the printing pin 12 and, thereby, retains it quickly in its rest position.

Figure 11:
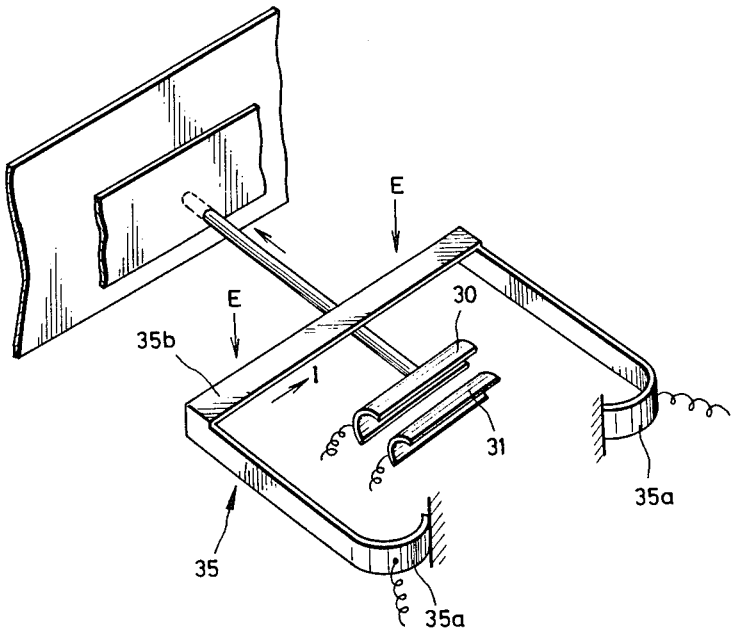
FIG. 11 is a perspective schematic illustration of the printing head of another embodiment according to the present invention wherein the electrode plate type damping means similar to that used in the embodiment of FIG. 8 is in cooperation with a transversal type electrodynamic actuator.
Figure 12:
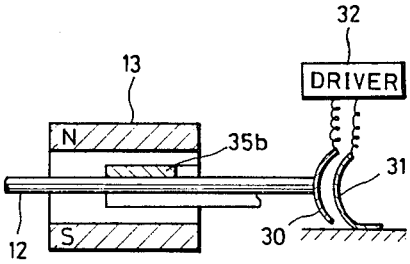
FIG. 12 is a cross sectional view showing the printing head of FIG. 11.

FIGS. 11 and 12 show a modification of the embodiment of the present invention shown in FIGS. 8 and 9, in which the looped-wire actuator comprising the actuating wires 10 and 11 is replaced with a transversal type electrodynamic actuator. This electrodynamic wire dot printing head has a transverse actuator comprising a generally U-shaped actuating member 35 which is fixedly supported to a part of the main body of the printing head through semicircularly rounded portions 35*a* while is resiliently deformable. At the middle of a transverse member 35*b* of the actuator 35, the same printing pin 12 as shown in the previous embodiments is attached to the transverse member 35*b* approximately at a right angle with respect thereto at its middle. As is shown in FIG. 12, the transverse member 35*b* of the actuator 35 is placed in a magnetic field E of the magnet 13. When passing a current I through the actuator 35 in a direction shown by an arrow in FIG. 11, the actuator deforms in such a way to thrust the printing pin 12 in its axial direction. On the other hand, when passing a counter current I through the actuator 35 in the opposite direction, the actuator 35 is restored so as to retract the printing pin 12 to its rest position.

Figure 10:
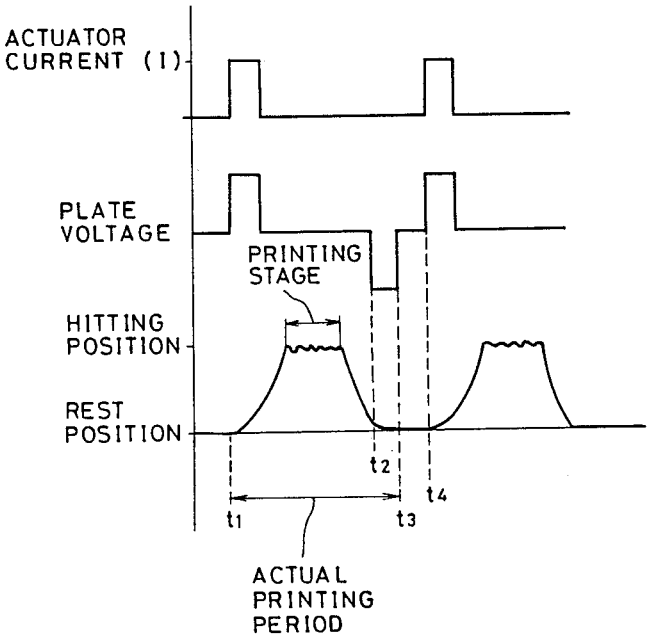
FIG. 10 is a diagram, similar to FIG. 1, showing the operation of the printing head of FIG. 8.

At the rear end of the printing pin 12, the same damping means as that of the previous embodiment shown in FIG. 8 to 10 is provided. The electrode plate member 30 is fixed to the rear end of the printing pin 12. Disposed facing to the electrode member 30 is the electrode plate member 31 fixed to a part of the main body of the printing head.

The transversal type wire dot printing head shown in FIGS. 11 and 12 and described above is operated in the same manner as described as to the previous embodiment shown in FIGS. 8 and 10 because of the provision of the same damping means as that of the previous embodiment.

Figure 13:
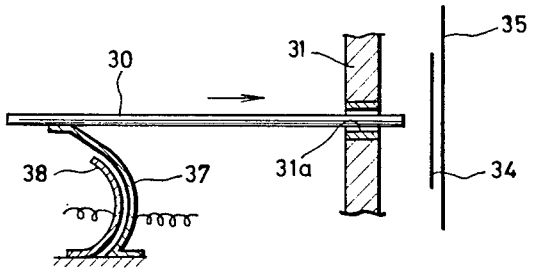
FIG. 13 is a side view showing the printing head of another embodiment according to the present invention wherein an electrode plate type damping means is used also as an electrodynamic actuator.
Figure 14:
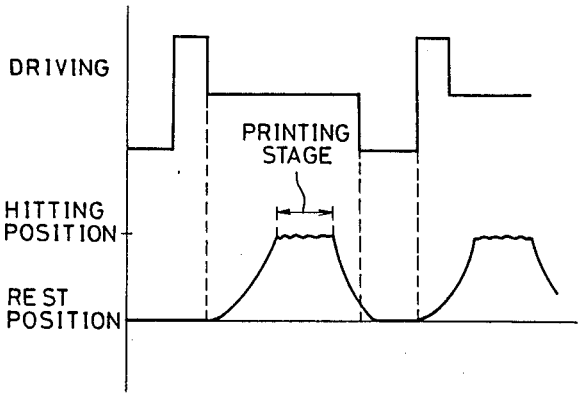
FIG. 14 is a diagram, similar to FIG. 1, showing the operation of the printing head of FIG. 13.

FIGS. 13 and 14 show another embodiment of the electrodynamic wire dot printing head according to the present invention. This embodiment is characterized in that the anti-rebound damping means which is basically the same as that of the embodiments shown in FIGS. 8 to 12 is also used for actuating the printing pin 12. The printing pin 12 is supported by an electrode plate member 37 made of a resiliently deformable, electrically conductive material, which functions as a damping means in combination with an electrode plate member 38. These electrode plate members 37 and 38 are shaped in a generally parabolic configuration in cross section. Each electrode plate members 37, 38 at its one end is fixed to a part of the main body of the printing head.

In operation of the printing head of this embodiment, plate voltages contrary in polarity to each other are passed through the electrode plate members 37 and 38, respectively so as to resiliently deform and attract the electrode plate member 37 by the remaining. Upon printing an ink dot, same polarity of voltages are passed through both the electrode plate members 37 and 38 to produce an electrostatical repulsion force therebetween. As a result, the electrode plate member 37 is restored to its initial state due to its own resiliency and the repulsion force so as to move the printing pin 12 in a direction shown by an arrow in FIG. 13, causing the printing pin 12 to hit the platen roller through the ink ribbon 19 and the printing paper 20 wrapped around the platen roller. After hitting the platen roller, the electrode platen member 37 rebounds to bend toward the electrode member 38. Simultaneously, plate voltages contrary in polarity to each other are passed through the electrode plate members 37 and 38 so as to generate an electostatical attractive force therebetween. Consequently, the electrode plate member 37 is held by the electrode plate member 38 to be retained in the rest position. As is apparent from the above-description, the printing pin 12 is prevented from oscillating.

Figure 15:
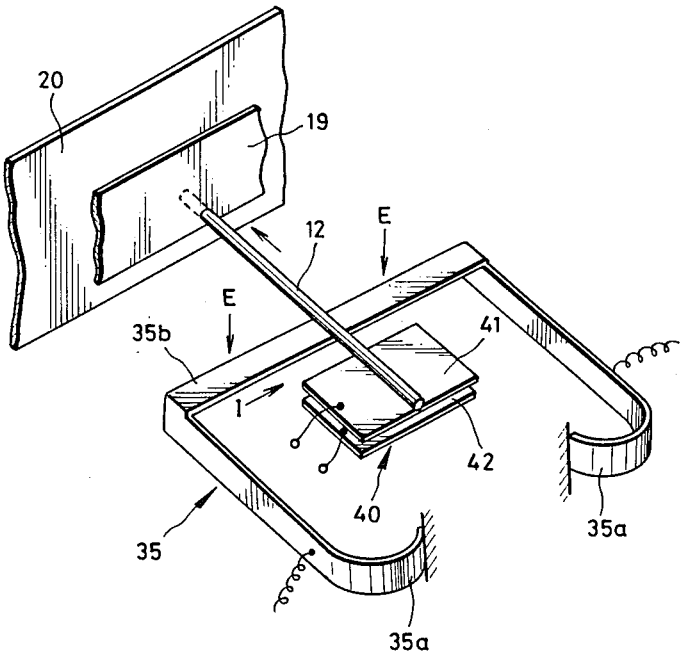
FIG. 15 is a perspective schematic illustration of the printing head of another embodiment according to the present invention which is similar to that of FIG. 11 but in cooperation with a different type electrode plate type damping means.
Figure 16:
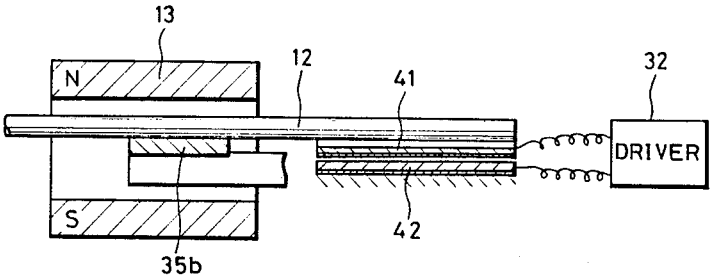
FIG. 16 is a cross sectional view of the printing head of FIG. 15.
Figure 17:
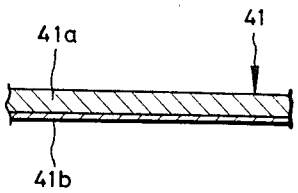
FIG. 17 is a cross sectional view showing an electrode plate member of the damping means used in the embodiment of FIG. 15.

FIGS. 15 to 17 show a still another embodiment of the electrodynamic wire dot printing head according to the present invention in which the same transversal actuator 35 as that used in the embodiment shown in FIG. 11 is used in cooperation with an elastically deformable anti-rebound damping means 40 which is attached to the printing pin 12 supported by the transversal actuator 35. The anti-rebound damping means 40 of this embodiment comprises a flexible electrode plate member 41 which is attached to the printing pin 12 at the rear end portion and a fixed electrode plate members 42 fixed to a part of the main body of the printing head. These electrode plate members 41 and 42 are connected to the driver 32. The driver 32 passes voltages contrary in polarity to each other through the electrode plate members 41 and 42 when printing and same polarity of voltages after printed.

As is shown in detail in FIG. 17, the electrode plate member 41 is made of an elastic plastic sheet 41*a* laminated with a thin sheet metal 41*b*. Preferably, each electrode member 41, 42 comprises a polyethyren telephtarate sheet of dimensions, 15×15 mm in size and 50 m in thickness, with an about 0.5 m thickness of alumiuium film 41*b* coated thereon. The electrode plate members 41 and 42 thus comprised are so disposed as not to be brought into contact between the aluminium films 41*b* when the electrode member 42 is elastically deformed due to an electrostatic force produced therebetween.

According to the anti-rebound damping means 40 shown in FIGS. 15 to 16, when the driver 32 applies voltages contrary in polarity to each other to the respective electrode plate members 41 and 42, an attractive force is produced between the electrode plate members 41 and 42 to elastically deform the electrode plate member 41, thereby the electrode member 41 is attracted by being brought into contact with the fixed electrode plate member 42 so as to grasp the printing pin 12 therebetween. As soon as the plate voltages applied thereto is removed, the attractive force disappears, the electrode member 41 resiliently restores to its initial state, making the printing pin 12 be movable. Therefore, by applying plate voltages contrary in polarity to each other to the electrode plate members 41 and 42 immediately after the printing of an ink dot, the printing pin 12 which is held in its rest position is prevented from making a resonant oscillation. As a result, a high speed printing is permitted. This sequential operation will be understood with reference to FIG. 10.

Figure 18:
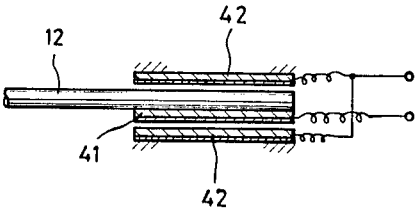
FIG. 18 is a side view of a variation of the damping means of the printing head of FIG. 15.

FIG. 18 shows an alternate of the embodiment of FIGS. 15 to 17, wherein two fixed electrode plate members 42 which are flexible are used in cooperation with the shiftable electrode member 41 disposed therebetween. In this embodiment, as the two fixed electrode plate members 42 are fixed along their opposite side margins, they elastically deform to bend inwardly so as to retain the shiftable electrode plate member 41 therebetween.

Figure 19:
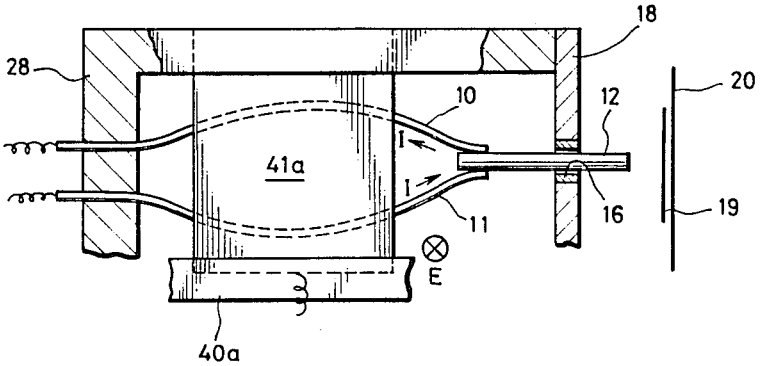
FIG. 19 is a plane view of the printing head of another embodiment according to the present invention wherein damping means similar to that of the embodiment of FIG. 15 is in cooperation with a looped-wire electrodynamic actuator.
Figure 20:
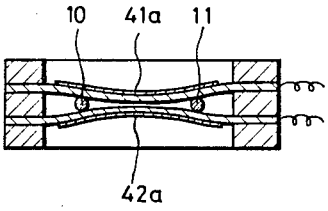
FIG. 20 is a cross section showing the printing head of FIG. 19.

FIGS. 19 and 20 show an embodiment wherein the elastically deformable anti-rebound damping means is applied to the actuator wires 10 and 11. Elastically flexible electrode plate members 41*a* and 42*a* similar to those used in the embodiment shown in FIGS. 14 to 16 are fixedly supported by a part of the main body of the printing head 28 in such a way to position the actuating wires 10 and 11 therebetween. As these electrode plate members 41*a* and 42*a* are elastically flexible, these electrode plate members 41*a* and 42*a* deform to bend inwardly when plate voltages contrary in polarity to each other are applied thereto. Consequently, the electrode plate members 41*a* and 42*a* retains the actuating wires 10 and 11 therebetween.

Figure 21:
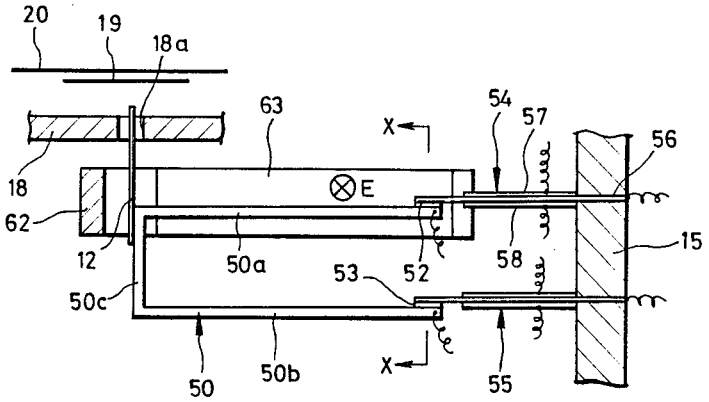
FIG. 21 is a schematic illustration of the printing head of another embodiment according to the present invention wherein a cantilevered U-shaped frame type actuator is used in cooperation with a bimorph damping means.
Figure 22:
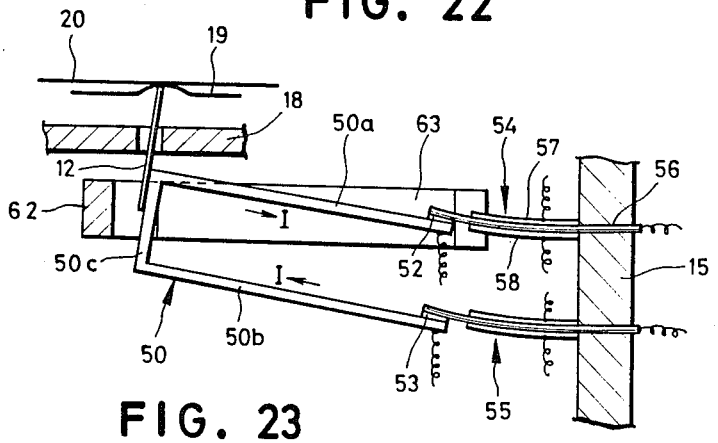
FIG. 22 is a schematic illustration of the printing head of FIG. 21 wherein the printing pin is in the hitting position.
Figure 23:
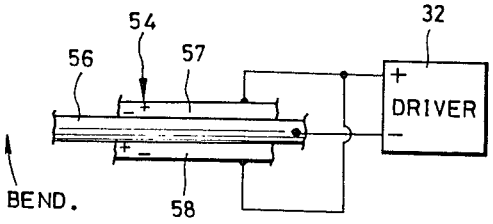
FIG. 23 is an explanatory illustration of the bimorph damping means of the printing head of FIG. 21.

Reference is now had to FIGS. 21 through 25 showing still another embodiment wherein the anti-rebound damping means that basically comprises a bimorph vibration element or elements is applied to a cantilever frame actuator. As is shown in FIGS. 21 and 22, a generally U-shaped cantilever frame actuator 50 comprises upper and lower longitudinal beams 50*a* and 50*b* interconnected at one end by a side beam 50*c* to which the printing pin 12 is fixedly attached. Each longitudinal beam 50*a*, 50*b* is secured to a leaf-shaped bimorph vibration element 54, 55 through an insulation member 52, 53. Each bimorph vibration element 54, 55 is, as is shown in FIG. 23, comprised by an electrode of resilient metal sheet 56 with piezoelectric plates 57 and 58 laminated on both sides thereof. One end portion of the resilient metal sheet 56 is fixedly supported by a part 15 of the main body of the printing head. Therefore, the frame actuator 50 is supported in the form of a cantilever with the aid of the bimorph vibration elements 54 and 55. A driver 60 is provided to drive the respective bimorph vibration elements 54 and 55.

Figure 24:
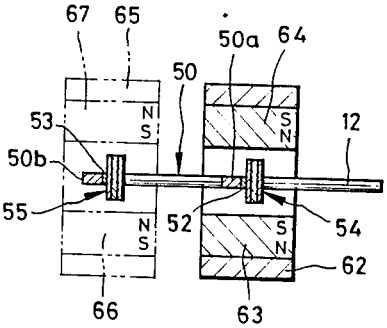
FIG. 24 is a cross sectional view showing a part of the cantilevered U-shaped actuator of the printing head of FIG. 21.

As is shown in FIG. 24, a holder 62 is stationarily disposed to hold a pair of magnets 63 and 64 so disposed as to provide a magnetic field therebetween. The upper longitudinal beam 50*a* is so placed between the magnets 63 and 64 as to cross the magnetic field perpendicularly upon moving in order to make the printing pin 12 hit the platen roller. If it is desirable to give the cantilevered U-shaped frame actuator 50 a more strong magnetic force, another pair of magnets 66 and 67 held by a holder 65 may be provided in such a way to position the lower longitudinal beam 50*b* therebetween as is shown by a double dotted line in FIG. 24.

In the guide plate 18, there is formed a guide hole 18*a* through which the printing pin 12 reciprocally moves. When the printing pin 12 hits the platen roller through the ribbon 19 and the printing paper 20, an ink dot is printed on the printing paper 20.

The cantilevered U-shaped frame actuator 50 is punched out from an aluminium sheet of 0.5 mm thickness. The longitudinal beam 50*a*, 50*b* has a length of about 30 mm and a width of about 3 mm, and the side beam 50*c* has a length of about 10 mm and a width of about 3 mm. For the printing pin 12, a stainless wire which has a diameter of 0.25 mm is welded to the side beam 50*c*. The bimorph vibration element 54, 55 comprises, for example, the resilient metal sheet 56 made of a phosphor bronze sheet of 0.3 mm thickness and 4 mm width and the piezoelectric plates 57, 58 made of zircon titanic plumbum cemented to the resilient metal sheet 56.

Figure 25:
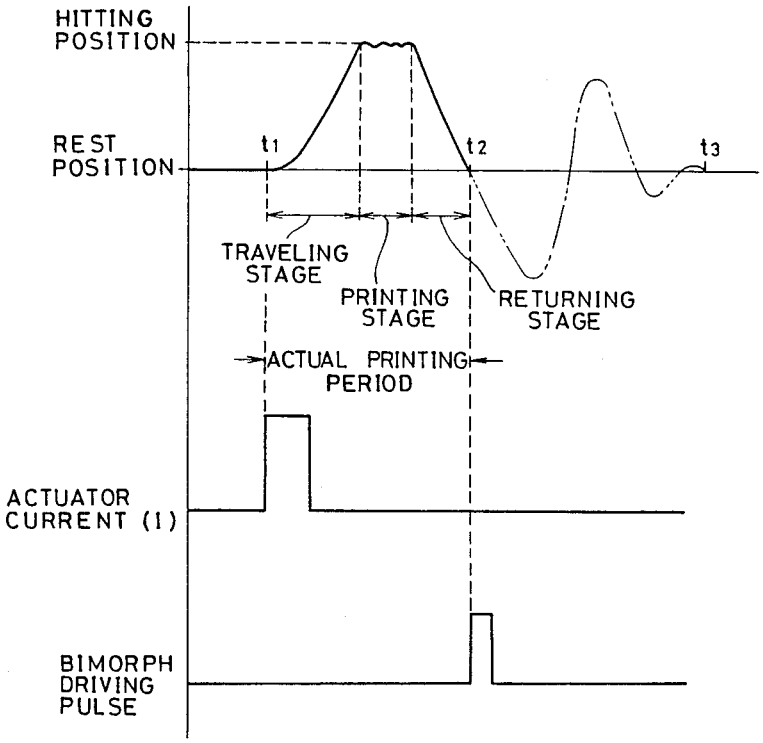
FIG. 25 is a graph, similar to FIG. 1, showing the operation of the printing head of FIG. 21.

In operation of the printing head having the cantilevered U-shaped frame actuator 50 in cooperation with the anti-rebound damping means comprising the bimorph vibration elements 54 and 55 of this embodiment, as is shown in FIG. 25, when a current pulse I is passed through the cantilevered U-shaped frame actuator 50 in a direction shown by an arrow in FIG. 21 at a time t1 while applying a magnetic field to the magnets 63 and 64, a magnetic force is exerted on the cantilevered U-shaped frame actuator 50, quickly resiliently deforming the bimorph vibration elements 54 and 55 so as to move the cantilevered U-shaped frame actuator 50 upwardly as viewed in FIG. 21. As a result, the printing pin 12 moves quickly from its rest position toward the hitting position, then hits the platen roller through the ink ribbon 19 and the printing paper 20, printing an ink dot on the printing paper 20.

Since the current pulse I is passed through the cantilevered U-shaped frame actuator 50 only at the beginning of the traveling stage, the cantilevered frame actuator 50 rapidly loses its kinetic energy upon hitting the platen roller. Consequently, the bimorph vibration elements 54 and 55 are restored due to its own resiliency to return the cantilevered U-shaped frame actuator 50 to the rest position. At the end of this returning stage, namely at a time the cantilevered frame actuator 50 has returned to the rest position shown in FIG. 21, a voltage is applied to the bimorph vibration elements 54 and 55 for a predetermined period by the driver 60 in such a way that the piezoelectric plate 57 contracts and, on the other hand, the piezoelectric plate 58 expands; the bimorph, vibration elements 54 and 55 are restored to its initial state without any vibration. Therefore, the cantilevered U-shaped frame actuator 50 is prevented from overextending beyond the rest position due to an inertia so as to stop quickly substantially at the rest position. It is noted that the bimorph vibration elements 54 and 55 are desirably deformed enough to cancel the inertia of the cantilevered frame actuator.

As is shown in FIG. 25, the actual period required to print an ink dot on the printing paper 20 is defined between a time t1 the traveling stage commences and a time t2 the returning stage terminates.

Figure 26:
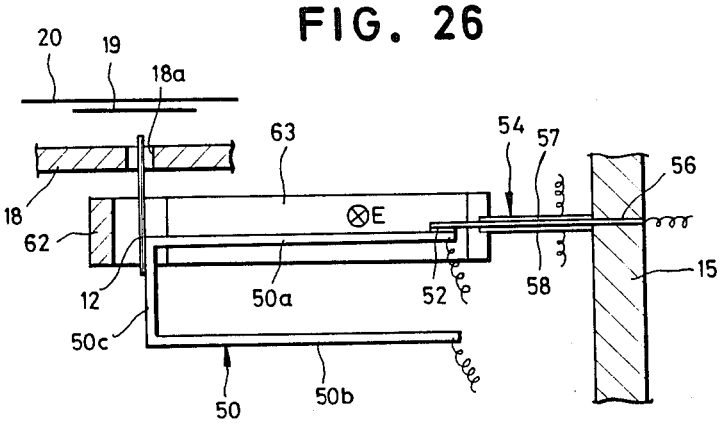
FIG. 26 is a schematic illustration similar to FIG. 21 showing a variation of the printing head of FIG. 21.

Although, in the above-described embodiment, there are two bimorph vibrators 54 and 55 as the anti-rebound damping means, it is permissible to omit one, desirably the lower one 55, of the two bimorph vibrators 54 and 55 as is shown in FIG. 26. In this embodiment, the printing pin 12 can have an increased stroke.

The bimorph vibrator element 54, 55 in the above described embodiment comprises two piezoelectric plates one of which is contractable and the other expandable. Nevertheless, it is permissible to construct the bimorph vibration element with two contractable piezoelectric plates. In this case, the bimorph vibrator element is caused to restore one of the two piezoelectric plates by releasing its contraction upon stopping the cantilevered frame actuator. It is desirable to maintain the cantilevered frame actuator in its rest position by resiliently deforming the bimorph vibration element to bend rearwardly and removing voltage being applied thereto upon starting the traveling stage. This results in a quick movement of the printing pin.

Figure 27:
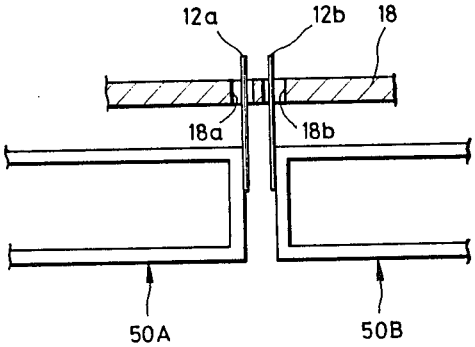
FIG. 27 is a schematic illustration showing an advantageous arrangement of the printing pins according to the embodiment shown in FIG. 21.

The electrodynamic wire dot printing head with the above-described cantilevered frame actuator is advantageous in applications wherein printing pins had to be arranged closely to print an ink dot thickly. As is shown in FIG. 27, two cantilevered frame actuators 50*a* and 50*b* are so arranged as to place the printing pins 12 close to each other. The printing pins 12 are guided by guide holes 18*a* and 18*b* formed in the guide plate 18 placed close to the ink ribbon not shown in FIG. 27.

In the case of arranging, for example, nine printing pins in two lines, a pair of the cantilevered frame actuators 50*a* and 50*b* are slightly shifted in a direction perpendicular to the plane of the drawing. In the same way, another pair of the cantilevered actuators is arranged adjacent to and close to the first pair of the cantilevered frame actuators 50*a* and 50*b*. A necessary number of the cantilevered frame actuators are arranged in a zigzag line so as to form two straight lines of the cantilevered frame actuators. It is preferable to put a thin insulation film between two adjacent printing pins to prevent them from an electrical interference therebetween.

Although the present invention has been described in connection with the preferred embodiments having particular combinations of actuators and anti-rebound damping means, any combination of the actuators and the anti-rebound damping means may be taken. From the structural point of view, the cantilevered frame actuator shown in several views may be supported, not by the bimorph vibration element, but by a resilient element such as a leaf spring.

Figure 28:
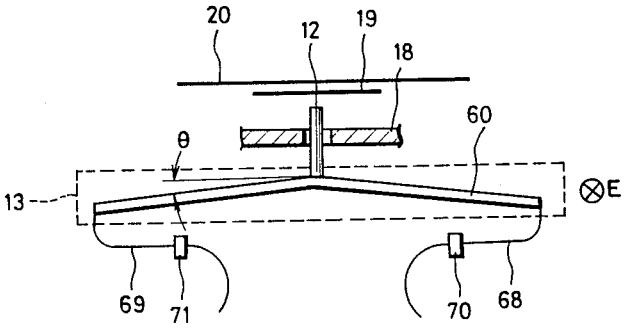
FIG. 28 is a schematic illustration of a simple transversal type electrodynamic actuator.

It is also permissible to use a generally V-shaped transversal actuator. As is shown in FIG. 28, a generally V-shaped transversal actuator wire 60 has an angular point at the middle where the printing pin 12 is fixed. The actuator wire 60 thus shaped is advantageous to increase rigidity. The angle $\theta$, which depends on the material thereof, is between 3 to 30 degrees, preferably about 10 degrees, to give a sufficient rigidity of the actuator wire 60. For the actuator wire 60, it is desirable to use a thin elongated plate made of copper, aluminium, aluminium alloy, plastic (ABS, polycarbonate) coated with a metal film, or the like rather than a rod. Specifically, in this embodiment, the transversal actuator 60 is made of an aluminium plate having dimensions, 1.5 mm width, 50 mm length, and 0.12 thickness.

The transversal actuator wire 60 is supported by a pair of resiliently deformable wires 68 and 69 held by supporting members 70 and 71 for movement parallel to the plane of the drawing and disposed in a magnetic field of the magnet 13. When the transversal actuator moves, the printing pin 12 is guided by the guide hole 18*a* formed in the guide plate 18. The transversal actuator 60 is operated substantially in the same way as the actuators previously described.

It is to be noted that there is not shown in FIG. 28 any anti-rebound damping means in cooperation with the transversal actuator 60 in FIG. 28; however any desirable for of the anti-rebound damping means previously described may be cooperatively applicable thereto.

Although the present invention has been fully described by way of the preferred embodiments thereof with reference to the accompanying drawings, it is to be noted that various changes and modifications are apparent to those skilled in the art. Therefore, unless otherwise such changes and modifications depart from the true scope of the present invention, they should be construed as included therein.

What is claimed is:

1. A printing head for a wire dot printer wherein a printing pin is adapted to hit a platen roller through an ink ribbon and a printing paper wrapped around the platen roller so as to print an ink dot on the printing paper, said printing head comprising:

magnetic means providing a magnetic field;

electrically conductive actuating means fixedly holding said printing pin, said actuating means being disposed in said magnetic field so as to resiliently deform under an electromagnetic force in order to give said printing pin a thrust motion from a position where said printing pin rests to a position where said printing pin hits said platen roller; and anti-rebound damping means for retaining said printing pin in said rest position, said anti-rebound damping means being in direct cooperation with said printing pin and including a pair of electrically conductive members one of which is fixed to said printing pin and the other to a fixed part of said printing head, an electromagnetically attractive force being produced between said pair of electrically conductive members upon an application of voltages contrary in polarity to each other to said pair of electrically conductive members, respectively, so as to electromagnetically attract one of said electrically conductive member to the other of said electrically conductive members in order to restrict said printing pin in said rest position.

2. A printing head as defined in claim 1, wherein said pair of electrically conductive members have substantially semicircular configurations in cross section complementarily to each other.

3. A printing head as defined in claim 1 wherein said electromagnetic actuating means includes a resiliently deformable, electrically conductive wire.

4. A printing head as defined in claim 1 wherein said electromagnetic actuating means includes a rigid, electrically conductive member supported by a resiliently deformable member.

5. A printing head as defined in claim 4 wherein said rigid member is substantially V-shaped.

6. A printing head for a wire dot printer wherein a printing pin is adapted to hit a platen roller through an ink ribbon and a printing paper wrapped around the platen roller so as to print an ink dot on the printing paper, said printing head comprising:

magnetic means providing a magnetic field;

electrically conductive actuating means fixedly holding said printing pin, said actuating means being disposed in said magnetic field so as to move under an electromagnetic force in order to give said printing pin a movement between a position wherein said printing pin rests and a position wherein said printing pin hits said platen roller, said actuating means including two parallel arms connected to each other at one end thereof, said end holding said printing pin;

a bimorph vibration element secured to each said parallel arm for supporting said actuating means in the form of a cantilever which is resiliently bendable to allow said movement of said actuating means, each said bimorph vibration element having an electrode of resilient metal sheet with piezoelectric plates on both sides thereof; and means for bending said bimorph vibration elements by applying a voltage thereto such that one of the piezoelectric plates expands and the other piezoelectric plate contracts when said printing pin has returned to said rest position so as to retain said actuating means and thereby retain said printing pin in said rest position.

7. A printing head as defined in claim 6 wherein said actuating means is made of aluminium.

8. A printing head for a wire dot printer wherein a printing pin is adapted to hit a platen roller through an ink ribbon and a printing paper wrapped around the platen roller so as to print an ink dot on the printing paper, said printing head comprising:

means for provided a magnetic field;

U-shaped electrically conductive actuating means to which said printing pin is attached, said actuating means being disposed in said magnetic field so as to move under an electromagnetic force in order to give said printing pin a movement between a position wherein said printing pin rests and a position whereat said printing pin hits said platen roller, said actuating means including two parallel arms connected to each other at one end, said end holding said printing pin;

a bimorph vibration element secured to one of said parallel arms for supporting said actuating means in the form of a cantilever which is resiliently bendable to allow said movement of said actuating means, said bimorph vibration element having an electrode of resilient metal sheet with piezoelectric plates on both sides thereof; and means for bending said bimorph vibration element by applying a voltage thereto such that one of the piezoelectric plates expands and the other piezoelectric plate contracts when said printing pin has returned to said rest position so as to retain said actuating means and thereby retain said printing pin in said rest position.

9. A printing head as defined in claim 8, wherein said bending means holds said U-shaped actuating means at at least one end thereof.

10. A printing head for a wire dot printer wherein a printing pin is adapted to hit a platen roller through an ink ribbon and a printing paper wrapped around the platen roller so as to print an ink dot on the printing paper, said printing head comprising:

magnetic means providing a magnetic field;

electrically conductive actuating means fixedly holding said printing pin, said actuating means being disposed in said magnetic field so as to resiliently deform under an electromagnetic force in order to give said printing pin a thrust motion from a position where said printing pin rests to a position where said printing pin hits said platen roller; and anti-rebound damping means for retaining said printing pin in said rest position, said anti-rebound damping means being in direct cooperation with said printing pin and including a pair of electrically conductive members one of which is fixed to said printing pin and the other to a fixed part of said printing head, an electromagnetic attractive force is produced between said pair of electrically conductive members upon an application of voltages contrary in polarity to each other to said pair of electrically conductive members, respectively, so as to deform at least one of said pair of electrically conductive members, thereby bringing said one of said pair of electrically conductive member into contact with the other electrically conductive member in order to retain said printing pin in said rest position.

11. A printing head as defined in claim 10, wherein said anti-rebound damping means further includes an electrically conductive member which is disposed opposite to said the other electrically conductive member with respect to said one electrically conductive member.

12. A printing head as defined in claim 10 wherein each of said electrically conductive members is made of a flexible plastic sheet coated with a thin film of metal.

13. A printing head for a wire dot printer wherein a printing pin is adapted to hit a platen roller through an ink ribbon and a printing paper wrapped around the platen roller so as to print an ink dot on the printing paper, said printing head comprising:

magnetic means providing a magnetic field;

electrically conductive actuating means fixedly holding said printing pin, said actuating means being disposed in said magnetic field so as to resiliently deform under an electromagnetic force in order to give said printing pin a thrust motion from a position where said printing pin rests to a position where said printing pin hits said platen roller; and anti-rebound damping means for retaining said printing pin in said rest position which is in cooperation with said electromagnetic actuating means, said anti-rebound damping means including a piezoelectric element resiliently deformable under an application of voltage thereto and a pin member fixed to said electromagnetic actuating element, said piezoelectric element being a fixedly disposed member through which said pin member is slidably guided and deformed to clamp said pin member so as to retain said printing pin in said rest position.

14. A printing head as defined in claim 13, wherein said piezoelectric member is fitted with a resiliently deformable annular ring thereinside.

15. A printing head for a wire dot printer wherein a printing pin is adapted to hit a platen roller through an ink ribbon and a printing paper wrapped around the platen roller so as to print an ink dot on the printing paper, said printing head comprising:

magnetic means providing a magnetic field;

electrically conductive actuating means fixedly holding said printing pin, said actuating means being disposed in said magnetic field so as to resiliently deform under an electromagnetic force in order to give said printing pin a thrust motion from a position where said printing pin rests to a position where said printing pin hits said platen roller; and anti-rebound damping means for retaining said printing pin in said rest position which is in cooperation with said electromagnetic actuating means, said anti-rebound damping means including a pair of electrically conductive members between which said electromagnetic actuating means is disposed and an electromagnetic attractive force is produced upon an application of voltages contrary in polarity to each other to said electrically conductive members so as to deform said electrically conductive members, thereby clamping said electromagnetic actuating means in order to retain said printing pin in said rest position.

16. A printing head as defined in claim 15, wherein said electrically conductive member is made of a flexible plastic sheet coated with a thin film of metal.

17. A printing head for a wire dot printer wherein a printing pin is adapted to hit a platen roller through an ink ribbon and a printing paper wrapped around the platen roller so as to print an ink dot on the printing paper, said printing head comprising:

magnetic means providing a magnetic field;

electrically conductive actuating means fixedly holding said printing pin, said actuating means being disposed in said magnetic field so as to resiliently deform under an electromagnetic force in order to give said printing pin a thrust motion from a position where said printing pin rests to a position where said printing pin hits said platen roller; and anti-rebound damping means for retaining said printing pin in said rest position including at least one bimorph vibration element for supporting said actuator means in the form of a cantilever which is resiliently bendable to allow said movement of said actuating means, each said bimorph vibration element having piezoelectric plates on both sides thereof which upon application of voltage thereto expand and contract, respectively, when said printing pin is returned to its rest position so as to retain said actuating means and thereby retain said printing pin in said rest position.

18. A printing head as defined in claim 17, wherein said anti-rebound damping means comprises a bimorph vibration element by which said electrodynamic actuating means is supported in the form of a cantilever.

19. A printing head for a wire dot printer wherein a printing pin is adapted to hit a platen roller through an ink ribbon and a printing paper wrapped around the platen roller so as to print an ink dot on the printing paper, said printing head comprising:

magnetic means providing a magnetic field;

electrically conductive actuating means fixedly holding said printing pin, said actuating means being disposed in said magnetic field so as to resiliently deform under electromagnetic force in order to give said printing pin a thrust motion from a position where said printing pin rests to a position where said printing pin hits said platen roller; and anti-rebound damping means for retaining said printing pin in said rest position including a guide plate disposed adjacent to said platen roller having a resiliently deformable annular guide bush and an annular deformable ring of piezoelectric element supported thereby, said piezoelectric element being fixedly disposed such that when said printing pin is thrusted, said piezoelectric element deforms on both sides of said pin to clamp said printing pin in said rest position when a voltage is applied thereto.

* * * * *